United States Patent [19]

Bakermans et al.

[11] Patent Number: 4,821,615

[45] Date of Patent: Apr. 18, 1989

[54] SLUG RETAINER FOR THE DIE ASSEMBLY OF A STAMPING AND FORMING MACHINE

[75] Inventors: Johannes C. W. Bakermans, Harrisburg; Abdollah Owzar, Camp Hill, both of Pa.

[73] Assignee: AMP Incorporated, Harrisburg, Pa.

[21] Appl. No.: 160,060

[22] Filed: Feb. 24, 1988

[51] Int. Cl.[4] ..... B26D 5/20; B26D 7/06; B26F 1/14

[52] U.S. Cl. ..... 83/147; 83/94; 83/149; 83/257; 83/686; 83/93

[58] Field of Search ..... 83/93, 94, 97, 147, 83/167, 149, 684, 685, 686, 257

[56] References Cited

U.S. PATENT DOCUMENTS

| | | | |
|---|---|---|---|
| 382,911 | 5/1888 | Shipley | 83/97 |
| 1,356,178 | 10/1920 | Thordarson | 83/93 |
| 1,881,189 | 10/1932 | Hjelte | 83/93 |
| 2,587,214 | 2/1952 | Polk | 83/93 |
| 2,618,311 | 11/1952 | Parker | 83/97 |
| 3,935,770 | 2/1976 | Bareis et al. | 83/97 |
| 4,497,196 | 2/1985 | Bakermans et al. | 83/628 |

FOREIGN PATENT DOCUMENTS

| | | | |
|---|---|---|---|
| 2121578 | 8/1972 | France | 83/97 |
| 587820 | 5/1947 | United Kingdom | 83/93 |

*Primary Examiner*—Frank T. Yost
*Assistant Examiner*—Scott A. Smith
*Attorney, Agent, or Firm*—Fritz L. Raring; Bruce J. Wolstoncroft

[57] ABSTRACT

Slug retainer for the die assembly of a stamping and forming machine comprises a thin sheet of resilient metal sheet has an integral ear which bears against the of the die assembly. Slugs produced by the punch and die are pushed through a slug passageway in the die assembly and through a slug opening in the sheet. The metal sheet has an integral ear which bears agains the endmost slug and which is flexed when the endmost slug is ejected. Slugs are thereby prevented from spilling when the removable portion of the die assembly is removed.

17 Claims, 7 Drawing Sheets

SLUG RETAINER FOR THE DIE ASSEMBLY OF A STAMPING AND FORMING MACHINE

FIELD OF THE INVENTION

This invention relates to stamping and forming machines of the type in which strip material is fed in a vertical plane along a feed path which extends between a punch assembly and a die assembly which are reciprocable towards and away from each other thereby to perform punching and other operations on the strip. The invention is particularly concerned with the problem of spillage of slugs from the die assembly when the tooling is changed and it is necessary to remove portions of the die assembly from the machine.

BACKGROUND OF THE INVENTION

U.S. Pat. No. 4,497,196 describes in detail a stamping and forming machine comprising one or more machine modules, each of which has a pair of opposed tooling assemblies which are reciprocated towards and away from each other. The strip material is fed in a vertical plane along a strip feed path which extends between the tooling assemblies so that operations, such as forming and punching operations, can be carried out on the strip. When a punching operation is carried out, one of the tooling assemblies will comprise a die assembly having an opening therein which receives a punch mounted in a punch assembly. During each cycle, then, a small section of scrap material, commonly referred to as a slug, is produced, and must be removed from the vicinity of the punch assembly and the die assembly. Because of the fact that the tooling assemblies of machines of the type shown in U.S. Pat. No. 4,497,196, are in a horizontal orientation, disposal of the slugs presents a problem which is not encountered with conventional stamping and forming machines in which the punch assembly reciprocates along a vertical path and the slugs can fall away from the tooling under the influence of gravity.

Application Ser. No. 89191 filed Aug. 25, 1987 (14059) describes a die assembly having a system for continuously disposing of the slugs produced during operation of the machine. The die assembly has a slug-receiving passageway extending therethrough from the die opening to a slug outlet which communicates with a slug-receiving cavity which is also in the die assembly. The slugs produced are thus stacked in the passageway and, during each operating cycle, the endmost slug is ejected at the slug outlet and falls into the slug-receiving cavity. The slugs are removed from this cavity by means of a conveyor belt which transports the slugs laterally to a disposal station which is beside the reciprocating die assembly. The slug disposal system described in the above identified application is effective to remove all the slugs produced during operation of the machine; however, it has been found that a problem is encountered when it is necessary to change the tooling in the machine by removing a removable portion of the die assembly and replacing it with a die assembly of a different design. When the machine is stopped, and the removable portion of the die assembly is taken from the machine, the slug-receiving passageway will be filled with a continuous stack of slugs remaining from previous operating cycles, and it has been found that some of these slugs will usually spill from the passageway and fall into portions of the machine from which the removable die section was taken. The slugs thus spilled must be carefully removed before another die section is installed in the machine for the reason that the slugs adhere to surfaces against which the die assembly bears during operation. Removal of the slugs can be a tedious and time-consuming operation; the slugs may be quite small and may be of very thin material, for example, 0.010 inches or less. Furthermore, the slugs and the bearing surfaces in the machine are always coated with a thin film of lubricant, and the slugs tend to adhere to the surfaces on which they fall. The present invention is thus directed to the achievement of a means for retaining slugs when the dies are changed in the machine and preventing spillage of any slugs from any portions of the die assembly. The benefit of such a system is that tooling changes can be made much more rapidly and possible damage to the machine (resulting from slugs which were not removed during a die change) is prevented.

THE INVENTION

One embodiment of the invention comprises a die assembly which is intended for use with a punch assembly in a stamping machine of the type in which strip material is fed in a vertical plane along a strip feed path which extends between the punch assembly and the die assembly. The punch assembly and the die assembly are both removably mounted in the machine in opposed confronting relationship. The die assembly has a die opening therein which is dimensioned to receive a punch carried by the punch assembly, and the die opening is in alignment with a slug passageway that extends through the die assembly to a slug outlet. The slug passageway has a cross-section which conforms to the shape of the slugs so that during continuous operation of the machine, a slug is produced during each operating cycle, and these slugs are accumulated in the passageway as a stack. During each cycle, the endmost slug of the stack is pushed from a slug outlet into a slug-receiving cavity. The die assembly is characterized in that a slug retaining means is provided at the slug outlet for preventing spillage of slugs from the passageway. The retaining means is on the die assembly adjacent to the slug outlet and extends partially across the slug outlet. The retaining means is resiliently deformable during movement of the stack of slugs through the slug passageway thereby to permit the endmost slug to pass from the slug outlet and is effective to retain the endmost slug in the stack during periods of non-operation of the machine. The die assembly can thus be removed from the machine without spillage of slugs. In accordance with further embodiments, the die assembly has a front end surface and a rear end surface, the front end surface being opposed to the punch assembly. The die opening and the slug passageway extend from the front end surface to the rear end surface. The slug outlet and the slug retaining means are on the rear end surface. The retaining means may comprise a flexible ear means on the rear end surface which extends partially across the slug outlet, and which is normally in engagement with the endmost slug and is flexed away from the rear end surface during passage of the endmost slug from the slug outlet. In the preferred embodiment, the ear means has a thickness which is equal to or less than the thickness of an individual slug and is normally in engagement with edge portions of the endmost slug. Advantageously, the flexible ear means is integral with a thin plate of resilient metal which is secured to the rear end surface of the die assembly. The ear may be in the form of a cantilever beam having a fixed end and a free end, the fixed end being integral with the thin resilient metal plate, and the free end extending over, or partially across, the slug outlet.

In accordance with further embodiments, the slug retaining means described above constitutes a primary slug retaining means, and a secondary slug retaining means is also provided. The secondary slug retaining means may be substantially similar to the primary slug retaining means and is mounted on a portion of the die assembly which is fixed and is not removed when a die change is made to the machine. When both a primary and a secondary slug retaining means are provided, the secondary retaining means is mounted on a reciprocable ram to which removable portions of the die assembly are secured. The ram has a slug receiving cavity therein, and the secondary slug retaining means extends over this cavity and prevents spillage of slugs therefrom when removable portions of the die assembly are taken from the machine.

THE DRAWING FIGURES

THE DISCLOSED EMBODIMENT

Figure 1:
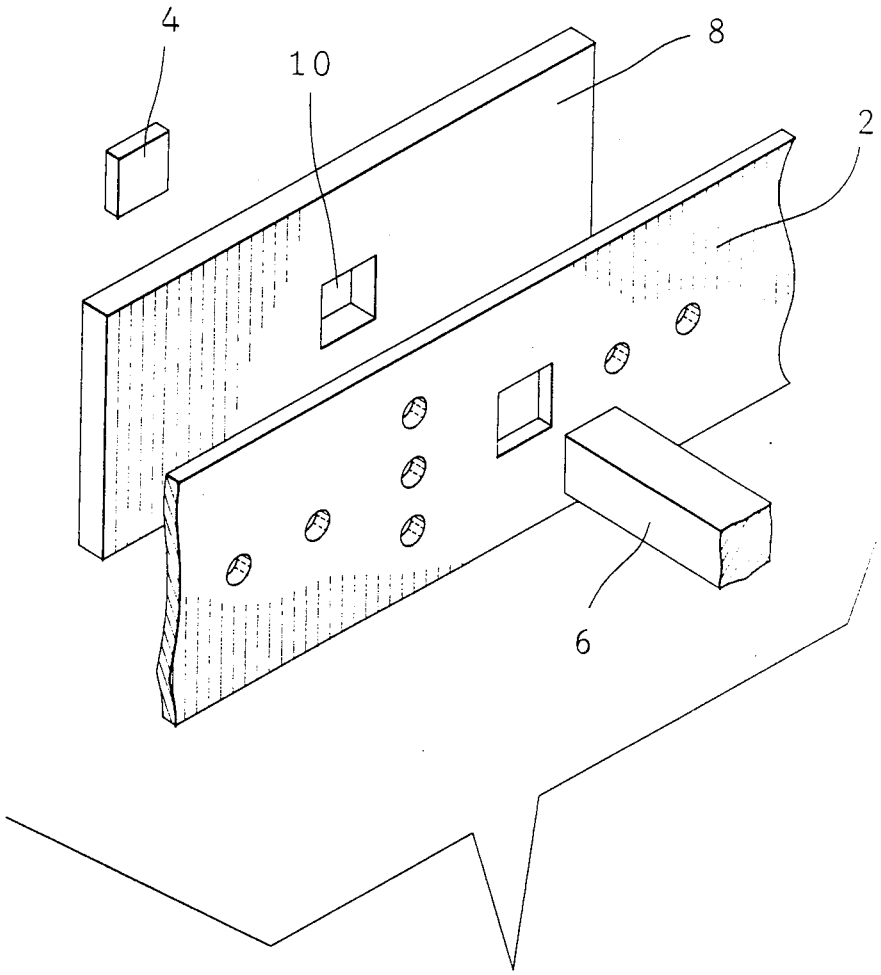
FIG. 1 is a perspective view showing the manner in which slugs are produced by a punch and die during a punching operation.
Figure 2:
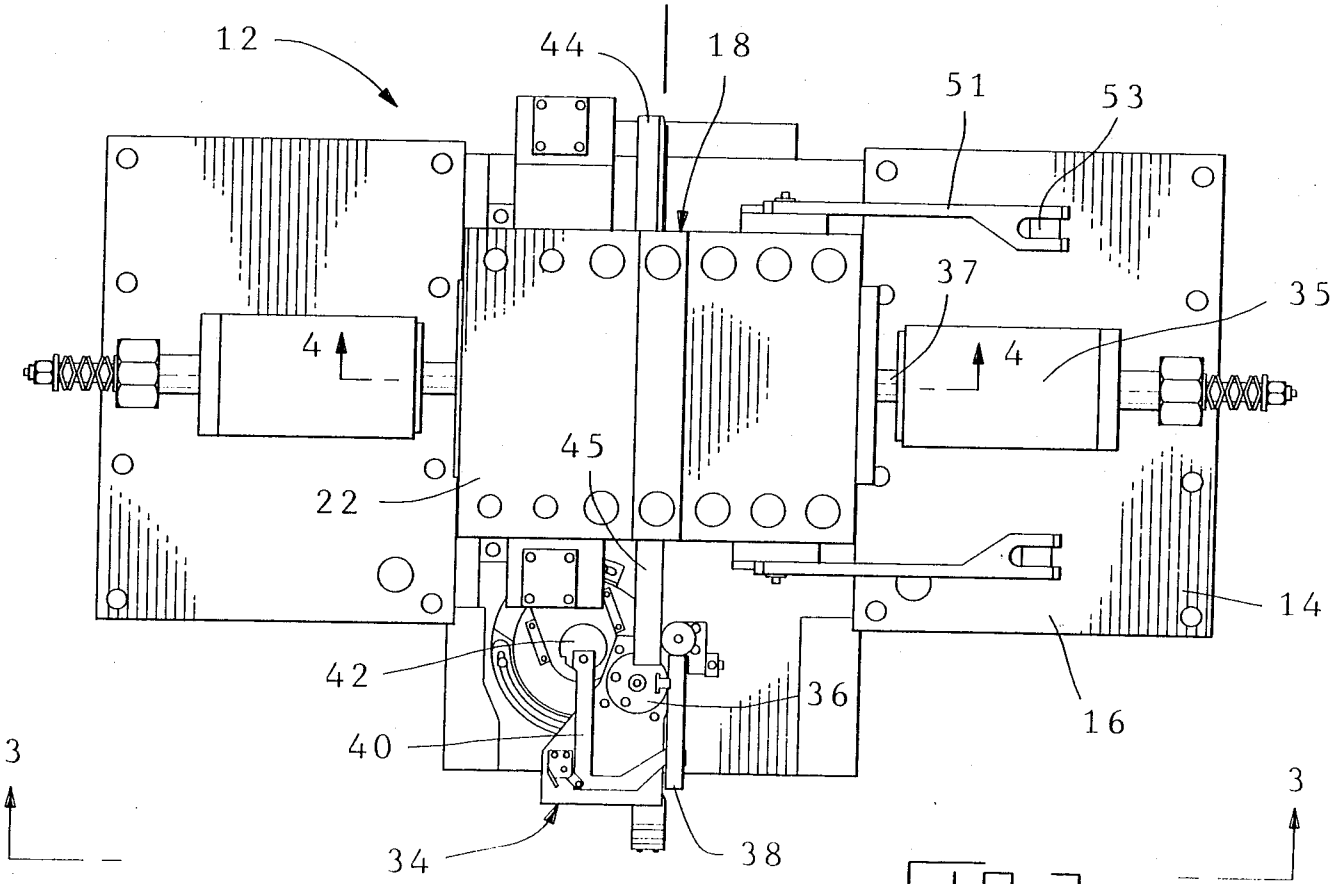
FIG. 2 is a top plan view of a machine module of the type in which the invention is used.
Figure 3:
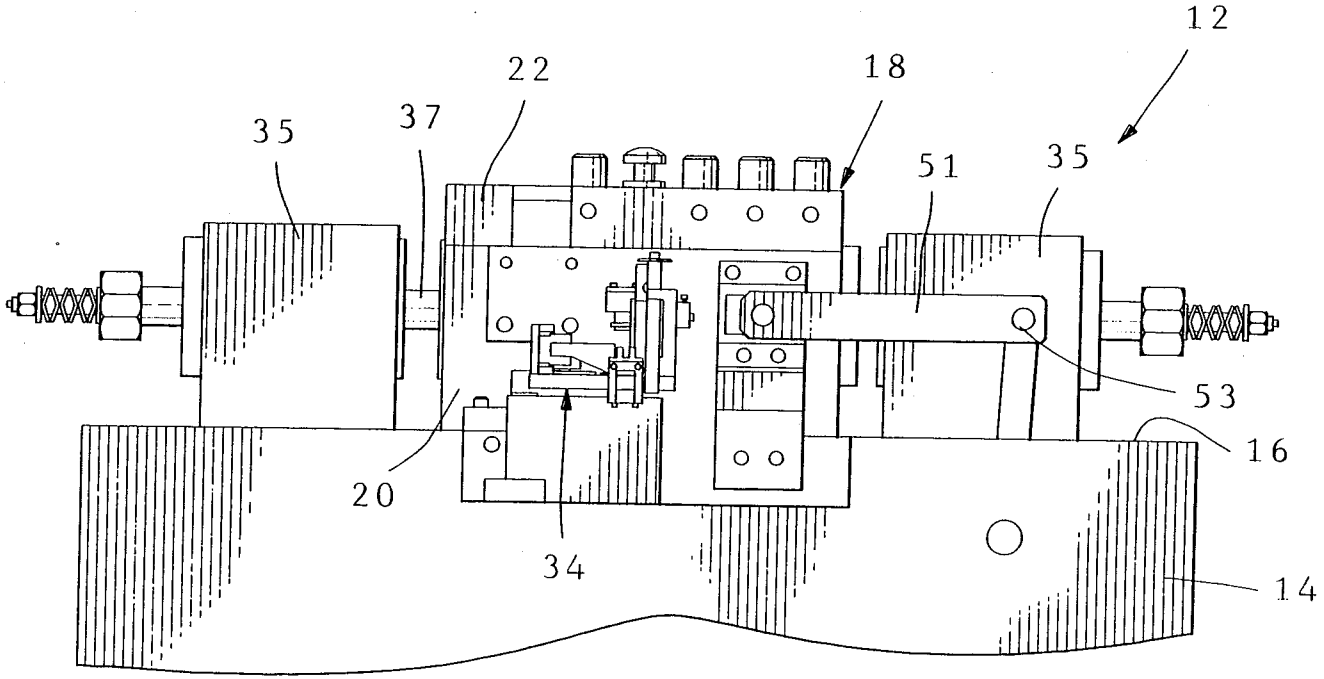
FIG. 3 is a side view looking in the direction of the arrows 3—3 FIG. 2.

FIG. 1 illustrates the manner in which a small slug of scrap metal 4 is produced from a strip 2 during each operating cycle of a stamping and forming machine as will be described below. The strip material 2 is fed in a vertical plane through a punching zone containing a die plate 8 and a punch 6. The die plate has a die opening 10 which is dimensioned to receive the punch. When the punch and die move relatively towards each other, the strip is supported by the die plate, and the punch shears the slug from the strip. The above-identified application Ser. No. 89191 (14059) describes a system for removing slugs 4 from the machine during continuous operation. The present invention is concerned with the problem of preventing spillage of slugs 4 when portions of the die assembly are removed from the machine, as for example, when tooling changes are being made.

FIGS. 2–5 show a single machine module 12 of the type described more fully in U.S. Pat. No. 4,497,196. The module, and particularly the punch assembly, will be described only briefly for the reason that the present invention is concerned with the die assembly.

Figure 4:
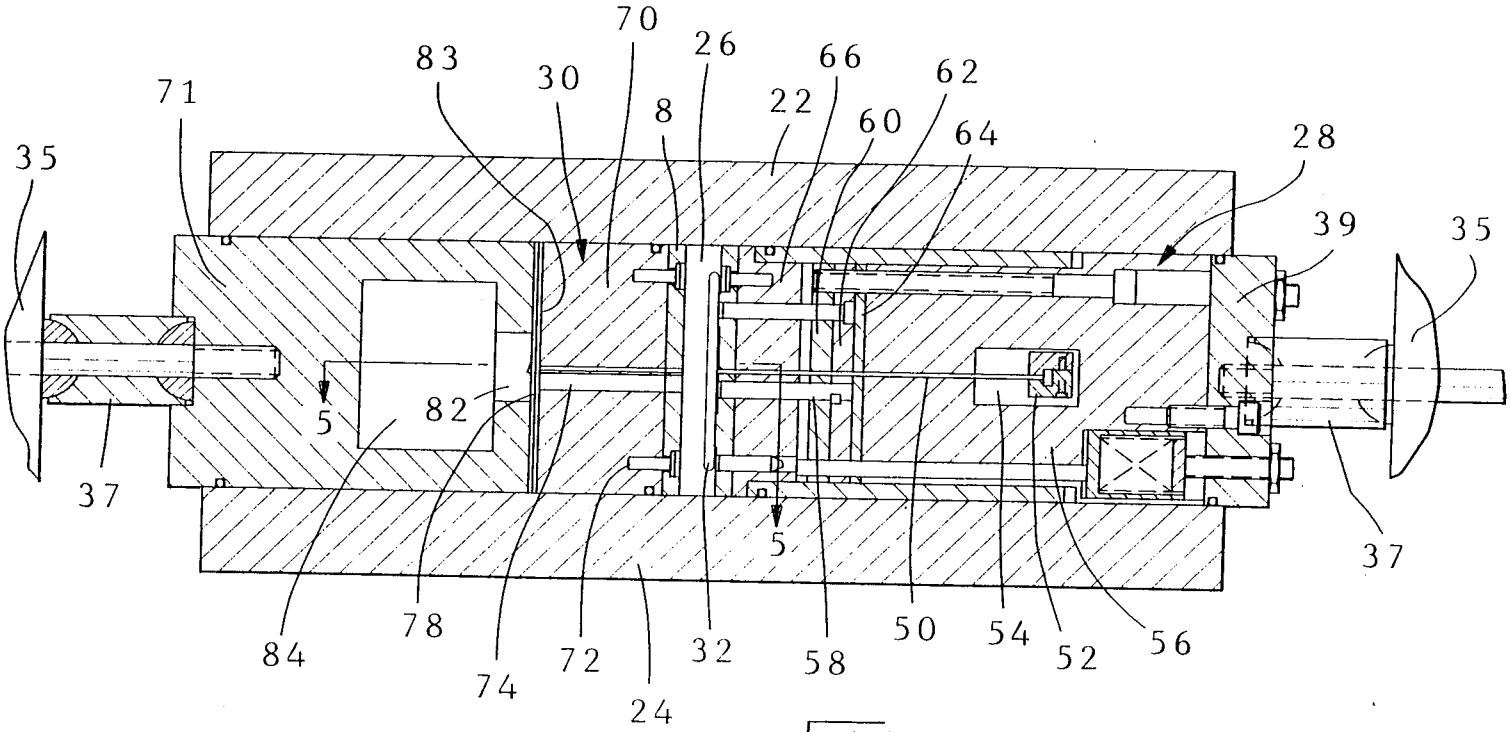
FIG. 4 is a sectional view looking in the directions 4—4 of FIG. 2.
Figure 5:
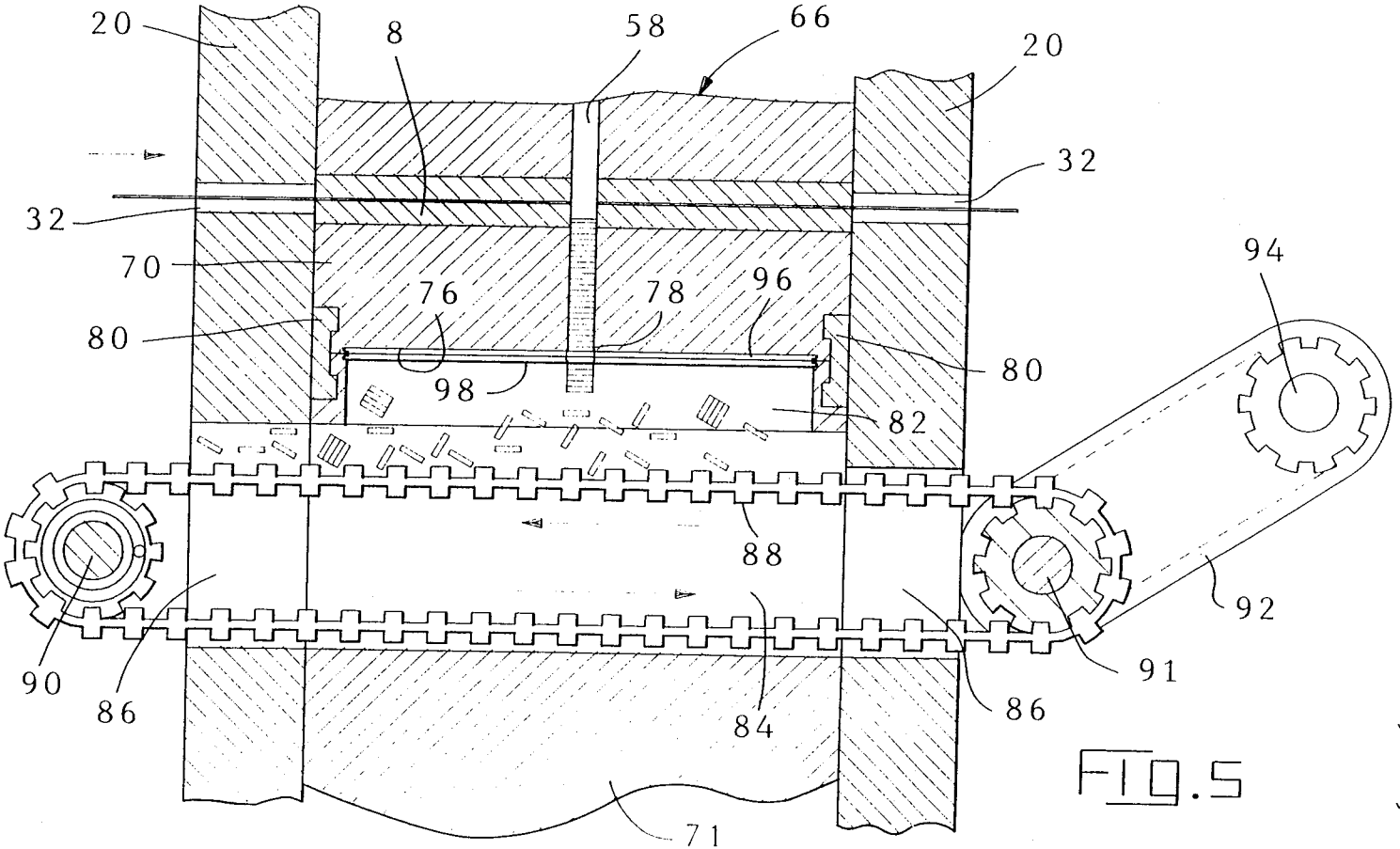
FIG. 5 is a fragmentary view looking in the direction of the arrows 5—5 of FIG. 4.

The module 12 comprises a module housing 14 on the upper surface 16 of which there is provided a tooling assembly housing 18. This housing has side plates 20, a cover plate 22, and a base plate 24. An opening 26 having a square or rectangular cross-section extends through this housing as shown in FIG. 4, and the punch assembly 28 and die assembly 30 are slidably mounted in this opening. The sides 20 of the tooling assembly housing 18 have aligned slots 32 through which the strip material 2 is fed by a strip feeding assembly 34, FIG. 2. The feeding assembly comprises a feed sprocket 36 which is rotated by a geneva mechanism (not specifically shown) and which has teeth which engage pilot holes in the strip material. During feeding intervals, the strip material is held against the feed sprocket by a strip guide 38 which is controlled by one of the arms of a bell crank 40. The guide 38 holds the strip against the sprocket during feeding intervals and moves away from the sprocket so that the strip is free during non-feeding intervals. The bell crank 40 is coupled at 42 to an eccentric which oscillate the bell crank 40 which in turn moves the guide 38 away from and towards the strip material in synchronism with the movements of the other parts of the machine. The strip is guided also by an input or upstream fixed guide 44 and a downstream fixed guide 45 which extends to the feed sprocket 36.

The punch assembly 28 and the die assembly 30 are moved towards and away from each other during each operating cycle by an actuating means which is fully described in the previously identified U.S. Pat. No. 4,497,196. The actuating means comprises levers having upper ends 35 which oscillate and which are coupled to the punch assembly and the die assembly by means of spacers 37. The punch assembly has a backplate 39 which is secured to the punch ram block 56 while the die ram block 71 is secured directly to its associated spacer 37.

The strip material has spaced apart pilot holes which are entered by pilot pins 50 thereby precisely to position the strip between the punch and die. These pilot pins 50 extend from a yoke 52 that extends through an opening 54 in the punch ram block 56. The ends of the yoke are pivotally connected to links 51, FIG. 2, which in turn are pivotally connected at 53 to levers which cause the pilot pins to move in advance of the ram block and enter the pilot holes in the strip before the punches, described below, engage the strip material.

Only a single punch 58 is shown in the disclosed embodiment although, it will be understood, quite often several punches may be provided in a single ram block. The punch 58 is secured at the left-hand end, as viewed in FIG. 4 of the ram block 56 by means of a tool holder plate 62 and a retainer plate 60, a hard metal spacer plate 64 being interposed between the face of the punch ram block and the tool holder plate 62. The punch assembly is also provided with a face plate assembly 66 comprising a guide plate and a backup plate through which the punch extends. This face plate assembly functions as a guide for the leading end of the punch and also as a stripper mechanism for preventing movement of the strip material with the punch when the punch is withdrawn from the opening in the strip material.

The die assembly 30 comprises, in addition to the previously identified die plate 8, a die backup or spacer plate 70 and a die ram block 71. The spacer block 70 is secured to the die plate by fasteners 72 and the ram block 71 is removably coupled to the backup block 70 by keys 80, FIG. 5. The backup block 70 has a slug receiving passageway 74 extending therethrough which is in alignment with the die opening and which extends to a slug outlet 78 which is at the lefthand end, as viewed in FIG. 4, of the block 70. The slug outlet 78 communicates with a slug receiving cavity 82 which extends into the leading end 83 of the ram block 71. The cavity 82 in turn communicates with a transverse opening 84 in the ram block 71 so that slugs emerging from the slug outlet will first enter the cavity 82 and then enter the transverse opening 84. Disposal of the slugs is accomplished by means of an endless belt 88 which extends around an idler sprocket 90 and a driven sprocket 91, these sprockets being located beside the side plates 20 of the tooling assembly housing 18. The sprocket 91 is coupled by a belt as shown at 92 to a continuously rotating sprocket 94 thereby to move the belt in the directions of the arrows shown in FIG. 5. The belt thus carries the slugs leftwardly, as viewed in FIG. 5, to the exterior of the tooling assembly housing.

The channel-shaped keys 80 which couple the backup or spacer block 70 to the ram block 71 are easily removed, and when it is desired to change tooling in the machine, it is only necessary to remove the housing cover 22, remove the keys 80, and lift out the removable portion of the die assembly. This removable portion comprises the die plate 8 and the die backup block 70.

When the removable portion of a die assembly is taken from the machine, the slug receiving passageway 74 will have a stack of slugs therein from previous operations, and the endmost slug of the stack will be located at the slug outlet. In order to retain the endmost slug in the passageway and to prevent spillage of slugs into the interior of the tooling assembly housing, primary and secondary slug retainers are provided on the block 70 and on the block 71, respectively, which will now be described.

Figure 8:
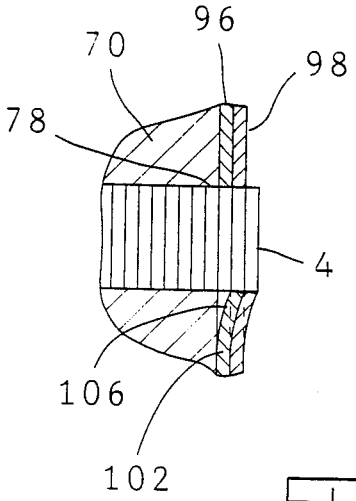
FIG. 8 is an enlarged fragmentary view illustrating the manner in which the slugs are retained.

The primary slug retainer comprises a thin sheet of resilient metal 96 which is held against the end of the block 70 as by a dovetail system 110, 112 described below. The sheet 96 has a slug opening 100 which is in alignment with the passageway and the slug outlet. A slug retainer in the form of a cantilever spring 102 is provided by removing material and providing slots 108 which extend from the outlet 100. The cantilever spring thus has a fixed end 104, which is integral with the sheet or plate 96, and a free end 106 which extends partially into the slug opening 100. This free end of the cantilever spring thus extends beyond the opening 100 and must be flexed as shown in FIG. 8 whenever a slug is ejected from the slug passageway. The slug ejected from the slug passageway passes through the opening 100 and is immediately engaged by the secondary slug retainer 98 which again comprises a relatively thin plate or sheet of resilient metal and which has a slug opening therein and a cantilever spring as is provided in the primary slug retainer. Advantageously, the thickness of the plates 96, 98 is less than the thickness of an individual slug so that the free end of the cantilever beam in each case will engage edge portions of the slug, see FIG. 8. The secondary retainer plate 98 in effect forms a wall between the transverse opening 84 and the slug receiving cavity 78 in the block 70. It will thus be apparent that slugs which have been pushed through both the primary and the secondary retainer will be in the opening 84 and cannot return past this wall when the removable portions of the die assembly are taken out of the machine. The slug which is beyond the endmost slug in the removable assembly will be held by the secondary retainer, while the endmost slug in the slug receiving passageway will be held by the primary slug retainer on the block 70.

Figure 6:
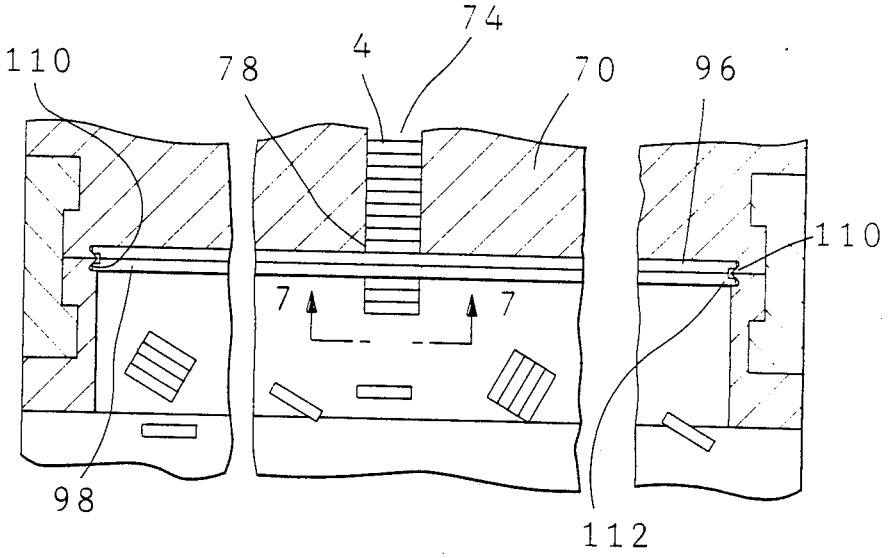
FIG. 6 is an enlarged view illustrating the manner in which the primary and secondary slug retainers are secured to removable and fixed portions, respectively, of the die assembly.
Figure 7:
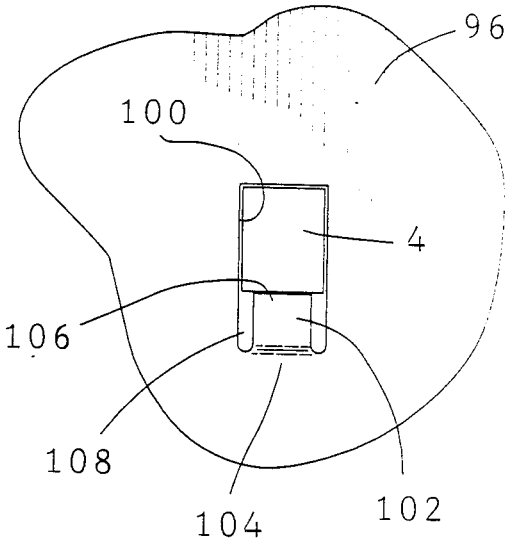
FIG. 7 is an end view looking in the direction of the arrows 7—7 of FIG. 6 showing the primary slug retainer.

FIG. 6 shows the manner in which the primary and secondary retainers are fitted onto the ends of the spacer block and the ram block respectively. Recesses as shown at 110 are provided in the faces of these blocks, and the side marginal edge portions 112 of the thin sheets are stepped as shown. The opposed surfaces of these sheets are against each other and the removable portion of the die can therefore be moved upwardly from the tooling housing leaving the secondary retainer 98 in position and forming the barrier wall as previously described.

The disclosed embodiment shows only a single punch in the punch assembly and a single die and slug receiving passageway in the die assembly. Obviously, more than one punch may be provided in the punch assembly, and a separate passageway and die opening is provided for each punch in the die assembly. The retainer plates would thus be provided with slug openings and cantilever beams in alignment with each of the slug passageways.

Figure 9:
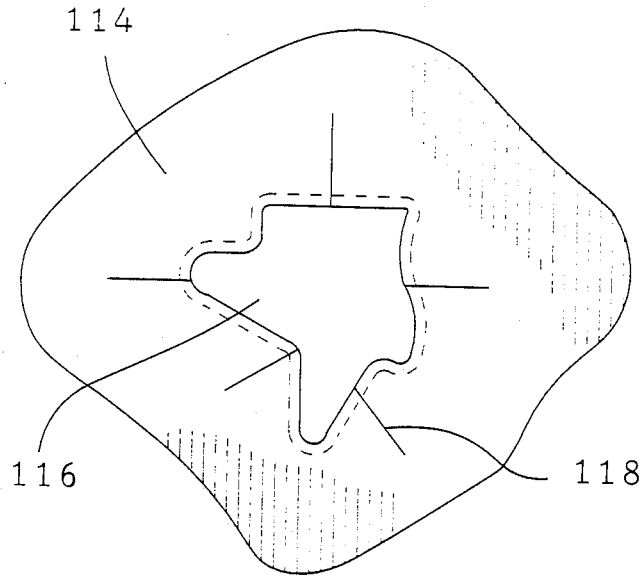
FIGS. 9 and 10 show alternative embodiments.
Figure 10:
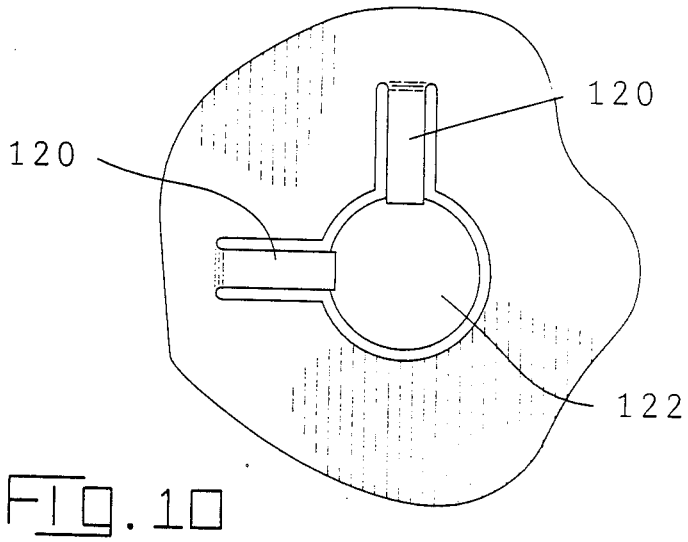

The disclosed embodiment shows a simple, rectangular slug, although quite often, the slugs produced may be of irregular shapes. FIG. 9 shows portions of a retainer plate 114 having an opening 116 which is adapted to receive an irregularly shaped slug. In this embodiment, shear lines 118 are provided in surrounding relationship to the openings thereby to form a plurality of cantilever beams which would be flexed upon passage of the slug through the opening. FIG. 10 illustrates an embodiment in which two cantilever beams 120 are provided for a disc-like slug 122. The principles of the invention can thus be used regardless of the exact shape of the slug or slugs being produced in the punching operation.

It will be seen from the foregoing description that the practice of the invention obviates the problem of spillage of slugs in a stamping and forming machine having tooling assemblies which reciprocate horizontally rather than vertically and that the tooling changes can therefore be carried out rapidly and without the danger of damage to the machine as a result of spilled and unrecovered slugs.

We claim:

1. A stamping machine having a punch assembly and a die assembly, the punch assembly and die assembly being in horizontal opposed confronting relationship and being reciprocable relatively towards and away from each other, strip feeding means for intermittently feeding strip material, which is in a vertical plane, along a strip feed path which extends between the punch assembly and the die assembly, the die assembly having a die opening therein which receives a punch carried by the punch assembly whereby, during each operating cycle, a slug is punched from the material and is pushed by the punch into the die opening, the die assembly having a slug receiving cavity therein which is spaced from the die opening and having a slug passageway extending from the die opening to a slug outlet which communicates with the slug receiving cavity so that slugs produced during continuous operation of the machine are stacked in, and pushed through, the passageway and into the slug receiving cavity, the die assembly comprising a removable portion and a fixed portion, the die opening and the passageway being in the removable portion, the slug receiving cavity being in the fixed portion, the stamping machine being characterized in that:

a primary slug retaining means is provided at the slug outlet for preventing spillage of slugs from the slug passageway, the primary retaining means being on the removable portion of the die assembly adjacent to the slug outlet and extending partially across the slug outlet, the primary retaining means being resiliently deformable during movement of the stack of slugs through the slug passageway thereby to permit the endmost slug of the stack to pass from the slug outlet, the primary retaining means being effective to retain the endmost slug in the stack during periods of non-operation of the machine whereby, the removable portion of the die assembly can be removed from the machine without spillage of slugs.

2. A machine as set forth in claim 1 characterized in that a secondary slug retaining means is provided on the fixed portion of the die assembly.

3. A machine as set forth in claim 2 characterized in that the removable portion and the fixed portion of the die assembly have end surfaces which are substantially against each other, the primary slug retaining means being on the end surface of the removable portion, the secondary slug retaining means being on the end surface of the fixed portion.

4. A machine as set forth in claim 1 characterized in that the primary slug retaining means comprises a primary flexible ear which extends partially across the slug outlet.

5. A machine as set forth in claim 1 characterized in that the primary slug retaining means comprises a primary cantilever spring having a fixed end and a free end, the free end extending partially across the slug outlet.

6. A machine as set forth in claim 3 characterized in that the end surfaces each has a slug retainer plate thereon and secured thereto, the slug retainer plates having slug openings therein which are in alignment with the slug passageway, the primary and secondary slug retaining means each comprising a flexible ear means which is integral with its associated retainer plate and which extends partially across the slug opening in its associated retainer plate.

7. A die assembly which is intended for use with a punch assembly in a stamping machine of the type in which strip material is fed along a strip feed path which extends between the punch assembly and the die assembly, the punch assembly and the die assembly being removably mounted in the machine in opposed confronting relationship, the die assembly having a die opening therein which is dimensioned to receive a punch carried by the punch assembly, the die assembly having a slug passageway extending from the die opening through the die assembly to a slug outlet, the slug passageway having a cross-section which conforms to the shape of the slugs, the machine having actuating means for moving the punch and die assemblies relatively towards and away from each other and for intermittently feeding the strip material whereby during continuous operation of the machine, a slug is produced during each operating cycle and is pushed into the die opening, and a stack of slugs is thereby accumulated in the slug passageway, and during each operating cycle, the endmost slug of the stack is pushed from the slug outlet, the die assembly being characterized in that:

a slug retaining means is provided at the slug outlet for preventing spillage of slugs from the slug passageway, the retaining means being on the die assembly adjacent to the slug outlet and extending partially across the slut outlet, the retaining means being resiliently deformable during movement of the stack of slugs through the slug passageway thereby to permit the endmost slug of the stack to pass from the slug outlet, the retaining means being effective to retain the endmost slug in the stack during periods of non-operation of the machine, the die assembly having a front end surface and a rear end surface, the front end surface being opposed to the punch assembly, the die opening and the slug passageway extending from the front end surface to the rear end surface, the slug outlet and the slug retaining means being on the rear end surface, the slug retaining means comprising flexible ear means on the rear end surface, the ear means extending partially across the slug outlet, the ear means being normally in engagement with the endmost slug and being flexed away from the rear end surface during passage of the endmost slug from the slug outlet whereby the die assembly can be removed from the machine without spillage of slugs.

8. A die assembly as set forth in claim 7 characterized in that the ear means is normally in engagement with edge portions of the endmost slug.

9. A die assembly as set forth in claim 7 characterized in that the rear end surface has a slug retainer plate secured thereto, the slug retainer plate having a slug opening therein which conforms to, and is in alignment with, the slug receiving passageway, the slug retaining means comprising flexible ear means which is integral with the retainer plate, the ear means being normally in engagement with the endmost slug and being flexed away from the rear end surface during passage of the endmost slug from the slug passageway.

10. A die assembly as set forth in claim 7 characterized in that the flexible ear means is of resilient metal and has a thickness which is less than the thickness of an individual slug.

11. A die assembly as set forth in claim 9 characterized in that the slug retainer plate is of resilient metal and has a thickness which is less than the thickness of an individual slug.

12. A die assembly as set forth in claim 9 characterized in that the flexible ear means is a cantilever spring having a fixed end and a free end, the fixed end being integral with the retainer plate, the free end extending into the slug opening and partially across the slug receiving passageway.

13. A die assembly as set forth in claim 11 characterized in that the flexible ear means is a cantilever spring having a fixed end and a free end, the fixed end being integral with the retainer plate, the free end extending into the slug opening and partially across the slug receiving passageway.

14. A die assembly as set forth in claim 11 characterized in that the flexible ear means comprises a plurality of flexible ears, each flexible ear comprising a cantilever spring having a fixed end and a free end, the fixed end being integral with the retainer plate, the free end extending into the slug opening and partially across the slug receiving passageway.

15. A die assembly as set forth in claim 7 characterized in that the machine has a reciprocable ram block, the ram block having a leading end which is adjacent to, and removably coupled to, the die assembly at the rear end surface thereof, the ram block having a slug receiving cavity in the leading end thereof, the slug receiving passageway communicating with the slug receiving cavity.

16. A die assembly as set forth in claim 15 characterized in that the slug retaining means is a primary slug retaining means and a secondary slug retaining means is provided on the ram block on the leading end thereof, the secondary slug retaining means being in alignment with the primary slug retaining means.

17. A die assembly as set forth in claim 15 characterized in that the rear end surface of the die assembly has a primary slug retainer plate secured thereto, the primary slug retainer plate having a primary slug opening therein which conforms to, and is in alignment with, the slug receiving passageway, the primary slug retaining means comprising a primary flexible ear means which is integral with the primary slug retainer plate, the primary ear means extending partially across the primary slug opening, the leading end of the ram block having a secondary slug retainer plate secured thereto, the secondary slug retainer plate having a secondary slug opening therein which is in alignment with the primary slug opening, the secondary slug retaining means comprising a secondary flexible ear means which is integral with the secondary slug retainer plate, the secondary ear means extending partially across the secondary slug opening.

* * * * *